United States Patent [19]

Suzuki

[11] Patent Number: 4,623,568

[45] Date of Patent: Nov. 18, 1986

[54] WRAPPING FILMS FOR "NORIMAKI" FOODS

[76] Inventor: Kisaku Suzuki, 19-8, Toshida 1-Chome, Nerima-ku, Tokyo, Japan

[21] Appl. No.: 776,857

[22] Filed: Sep. 18, 1985

[30] Foreign Application Priority Data

Oct. 17, 1984 [JP] Japan ..... 59-157340[U]
May 28, 1985 [JP] Japan ..... 60-79803[U]

[51] Int. Cl.[4] ..... B65D 75/02; B65D 75/28

[52] U.S. Cl. ..... 428/40; 229/87 F; 426/115; 428/189; 428/194

[58] Field of Search ..... 428/35, 192, 40, 189, 428/194; 206/484; 229/87 F; 426/115

[56] References Cited

U.S. PATENT DOCUMENTS 2,055,333 9/1936 Burke ..... 229/87 F
4,230,728 10/1980 Tezuka ..... 426/115
4,247,564 1/1981 Tezuka ..... 229/87 F
4,251,552 2/1981 Uno et al. ..... 229/87 F
4,251,553 2/1981 Kobayashi ..... 229/87 F

*Primary Examiner*—Paul J. Thibodeau
*Attorney, Agent, or Firm*—Fred Philpitt

[57] ABSTRACT

The wrapping film is composed of an external film and a pair of separating films disposed on an inner surface of the external film, and the pair of the separating films form an accommodating portion for accommodating a laver between the external film and the pair of the separating films by superposing mutual edges thereof in almost the center portion of the external film in free condition, and the laver is accommodated between the external film and the pair of the separating films, and rice is placed on the separating films to be wrapped in with the laver being wrapped in the separated condition from the rice, and a cut line is provided at a position along the superposed edges of the separating films, and when the external film is cut in the center portion and is separated in right and left directions, the rice is spontaneously wrapped in the laver.

2 Claims, 11 Drawing Figures

WRAPPING FILMS FOR "NORIMAKI" FOODS

BACKGROUND OF THE INVENTION

This invention relates to wrapping films for unique Japanese food called [Norimaki] produced by wrapping up the rice in laver, namely, to wrapping film for [Maki-zushi] (seasoned rice rolled in laver), Norimaki food to wrap and preserve [Onigiri] (hand rolled rice in triangular shape), particularly, this invention relates to a wrapping film for [Norimaki] food which is prepared by providing a separation film on an inner surface of an external film, accommodating a laver between the external film and the separation film, placing the rice on the separation film, wrapping it up, wrapping the laver in a condition where the laver is separated from the rice. In case a customer wants to eat it, when he cuts the center portion of the external film, the external film and the separation film are divided into two parts, right and left, and he pulls the external film apart in right and left directions, the rice is spontaneously wrapped up in the laver and he is ready for eating.

Heretofore, in the Japanese foods called [Norimaki], there have been [Maki-zushi] and [Onigiri]. In case of [Maki-zushi], the rice rolled in laver in round or square cross section in most cases is always seasoned. In case of [Onigiri], the rice rolled in laver is not necessarily seasoned, and moreover, the rice is hand shaped into a triangle in most cases and this triangular rice is wrapped up in laver.

In recent years, drive-in restaurants and the like are developing according to a change of social life and [Maki-zushi] including "tekka-maki", "kappa-maki", "kanpyo-maki" (these three maki-zushi have as core food, fish meat, cucumber, dried gourd shavings) and [Onigiri] are being sold in supermarkets or foodstores. [Maki-zushi] and [Onigiri] being sold as take-out foods are in such forms that "laver" is contained in a moisture preventive synthetic resin film wrapper or bag and is packed being separated from "rice" by taking a moisturing property of the laver into consideration, and in case a customer wants to eat it, he unseals the film wrapper to take out the "laver" and puts "rice" on "laver" to roll in and eats it. However, in the conventional wrapping system mentioned in the foregoing, unsealing the film and removing the "laver" were troublesome for a customer and he was required to hold the laver and the rice directly with hands to roll in which were drawbacks requiring unsanitary and cumbersome work.

SUMMARY OF THE INVENTION

An object of this invention is to provide wrapping films for [Norimaki] food in which a laver is placed in a bag like accommodating portion formed by an external film provided with a cut line in its almost center and a pair of separating films, and rice placed on the separating film is wrapped in a wrapping film, and when a customer wants to eat it, he merely unseals the cut line of the external film to separate the wrapping film simply and when the wrapping film is separated in right and left directions by means of the cut line, said pair of the separating films being separated in right and left directions, and thus, he can eat [Onigiri] in which the rice is spontaneously wrapped in the laver.

BRIEF DESCRIPTION OF THE DRAWINGS

FIG. 8 is a perspective view of the condition where [Onigiri] is wrapped in.

DETAILED DESCRIPTION OF THE INVENTION

Figure 1:
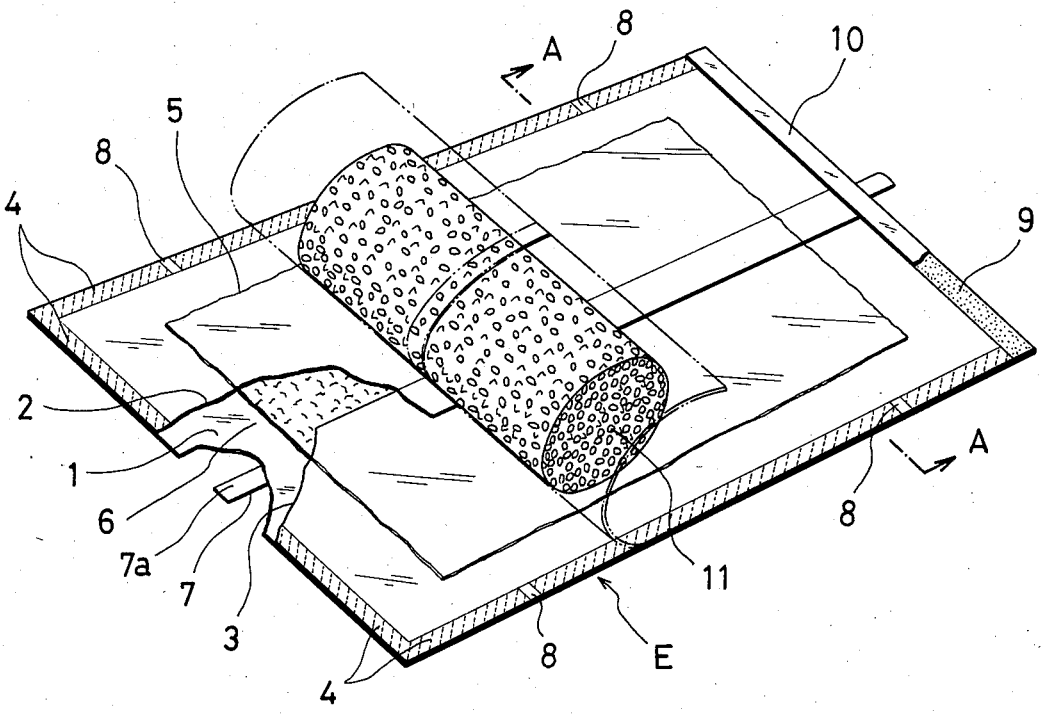
FIG. 1 is a perspective view of the wrapping film shown in partly cross section before wrapping [Maki-zushi].

The wrapping film represented by a normal letter E is formed in such way that a pair of separating films 2, 3 made of a transparent cellophane and the like are disposed on an inner surface of a rectangular external film 1 made of the same material with said separating films, and said pair of the separating films 2, 3 are superposed with their edges in free condition in the center portion, and seal portions 4 such as heat seal are applied to right and left edges and lower edge excluding an upper edge to be bonded with the external film 1, and a bag like accommodating portion 6 for accommodating a laver 5 between the external film 1 and the separating films 2, 3 is provided, and in almost the center of the external film 1, a cut line 7 is provided at a position along the edge where the separating films 2, 3 are superposed.

The seal portions 4 are provided at three locations in this embodiment, but this invention is not necessarily limited to the locations, one location or two locations may be provided. Also, an opening tape 7*a* is utilized for the cut line 7 in the embodiment shown in FIG. 1 through FIG. 3, and the external film 1 is arranged to be separated at almost the center by peeling off the opening tape 7*a*.

Figure 2:
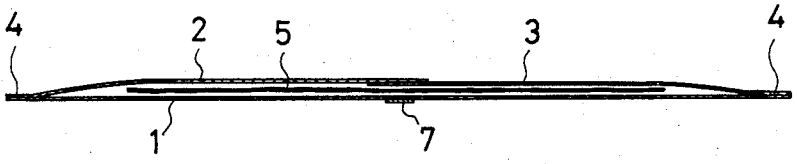
FIG. 2 is a cross section taken along a line A—A of FIG. 1.

As shown in FIG. 1, an air vent 8 is provided on the seal portions 4 of the external film 1 and the separating films 2, 3. A bonding agent 9 is coated on the upper edge of the inside of the external film 1, and this bonding agent 9 is pasted with the peeling tape 10.

Figure 3:
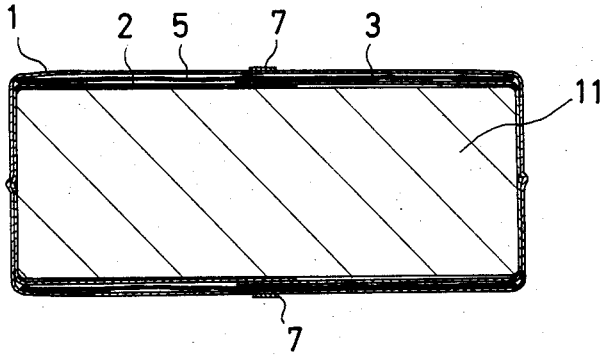
FIG. 3 is a cross section showing the condition in which the rice is wrapped in together with the laver.
Figure 4:
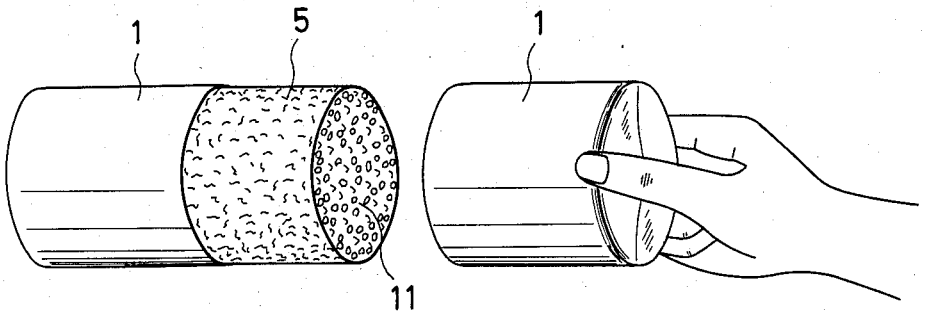
FIG. 4 is a perspective view showing the condition in which one side of the wrapping film is separated by the cut line from the wrapped condition.
Figure 5:
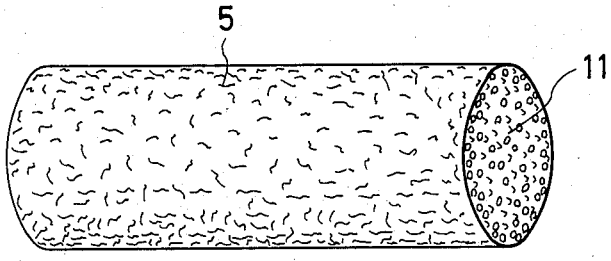
FIG. 5 is a perspective view of [Maki-zushi] of the condition where rice is wrapped in the laver after it being taken out from the wrapping film.
Figure 6:
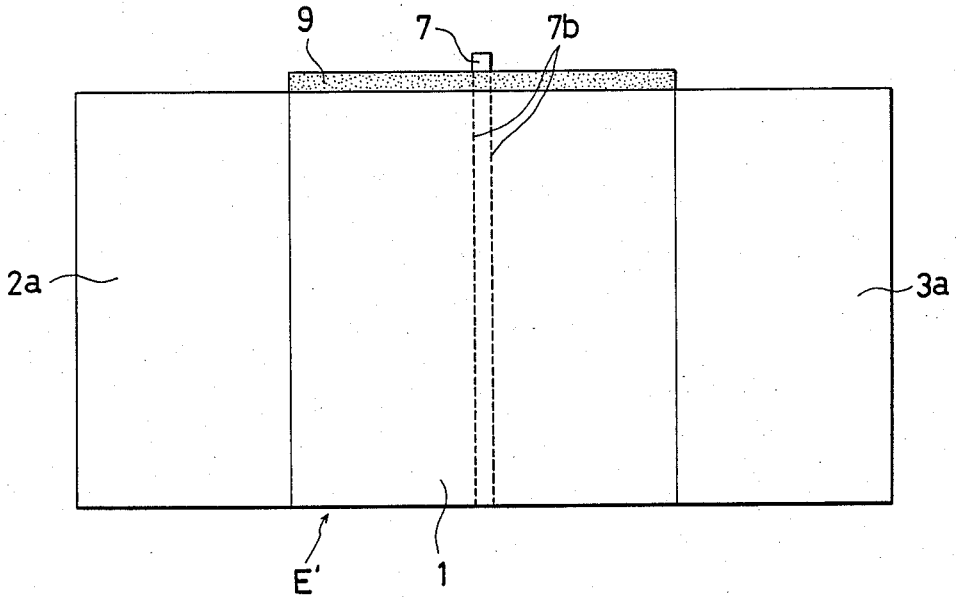
FIG. 6 is a developed view of the wrapping film showing a second embodiment of this invention.

Accordingly, in this invention, in order to wrap [Maki-zushi] using the wrapping film E, the laver 5 is inserted into the bag like accommodating portion 6 formed by the external film 1 and the separating films 2, 3, and thereafter, the rice 11 formed in bar shape is placed at the outsides of the separating films 2, 3 as shown in FIG. 1. And then, the rice 11 is rolled in the direction of an arrow mark as shown in a dotted line of FIG. 1, and the peeling tape 10 is peeled off and is pasted to the outer surface of the external film 1 by means of the bonding agent 10, and both side portions are folded as shown in FIG. 3 and are fixed by the seal and the like.

In this condition, the resulting food is sold as [Maki-zushi] such as "tekka-maki", "kappa-maki", "kanpyo-maki".

On the other hand, when a customer wants to eat [Maki-zushi] wrapped in such way, he picks up a projecting end piece of the opening tape 7*a* forming the cut line 7 and pulls it and separates the external film 1 by the cut line 7 that is almost the center and pulls it in right and left directions. Thus, as mutual edges of the separating films 2, 3 are superposed in free condition at the position along the cut line 7, the separating films 2, 3 together with the external film 1 are pulled out and are removed, and and he can eat the bar shaped rice 11 directly wrapped in the laver 5.

By the way, FIG. 6 through FIG. 11 show the second embodiment of this invention.

In this embodiment, a wrapping film E′ is formed in such way that separating films 2*a*, 3*a* are serially extended at both sides of an external film 1*a*, and these separating films 2, 3 are folded inside to form an accommodating portion 6*a* for accommodating a laver 5 between the external film 1*a* and the separating films 2*a*, 3*a*. A cut line by machined line 7*b* is provided at a position along superposed edges of the separating films 2*a*, 3*a* in almost the center of the external film 1*a*.

Figure 7:
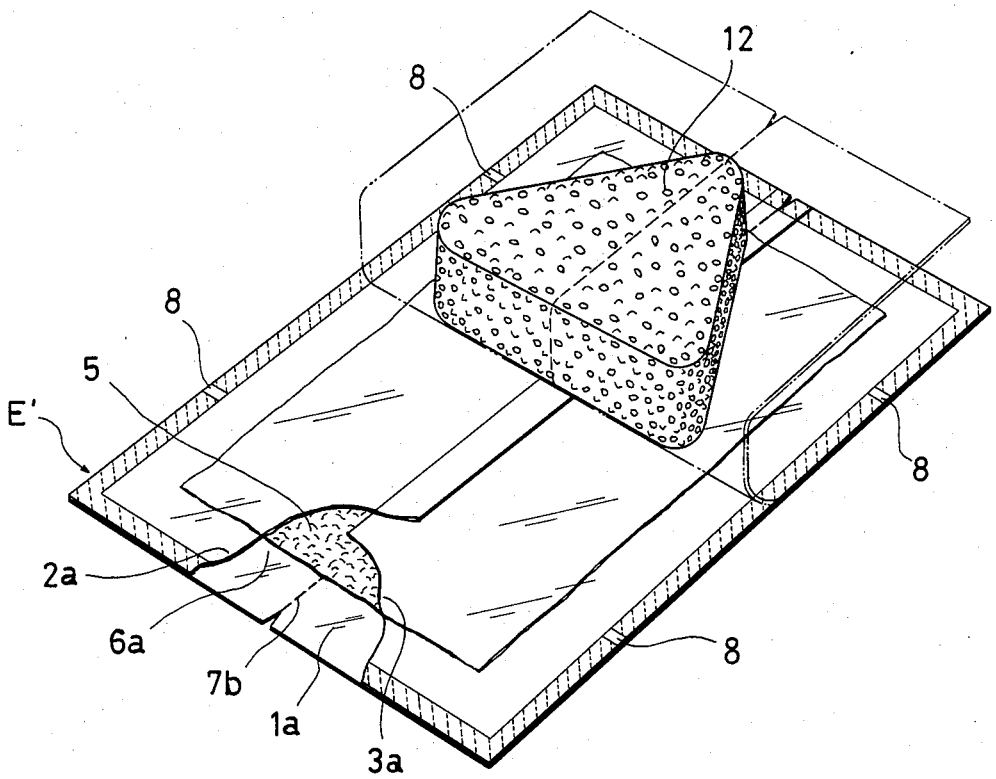
FIG. 7 is a perspective view of the wrapping film of the second embodiment showing a partial cross section in the condition before [Onigiri] being placed and wrapped.

The wrapping film E′ in this second embodiment is suitable for wrapping [Onigiri] 12. As shown in FIG. 7, the laver 5 is accommodated on an inner surface of the external film 1*a* and the separating films 2*a*, 3*a* are folded over the laver 5 and the [Onigiri] 12 is placed on the separating films 2*a*, 3*a*. Next, as shown in the dotted line of FIG. 7, the external film 1*a* is twofolded, and as shown in FIG. 8, the corner portions of both sides of the external film are folded and are fixed by a seal piece 13 to complete the wrapping.

Figure 8:
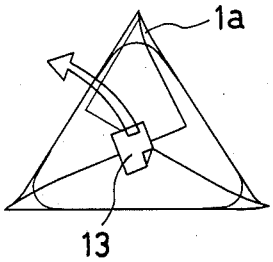
Figure 9:
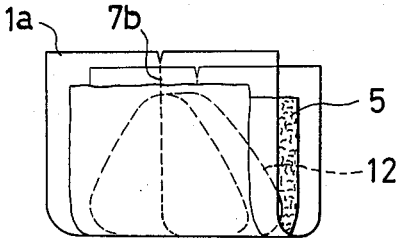
FIG. 9 is a perspective view showing the condition where the seal is peeled off.
Figure 10:
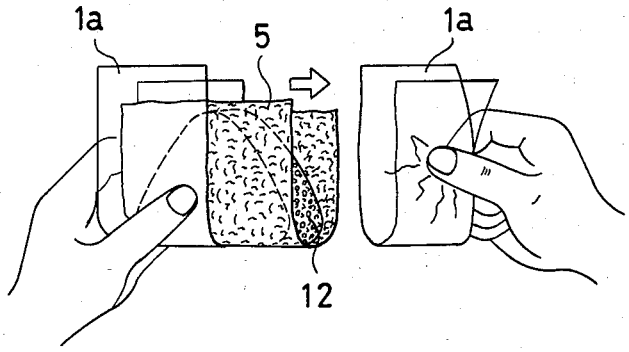
FIG. 10 is a perspective view of the condition where one side of FIG. 9 is separated along the cut line.
Figure 11:
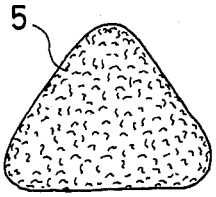
FIG. 11 is an explanatory view of the condition where [Onirigi] is wrapped in the laver.

In case a customer wants to eat [Onigiri] 12 wrapped in the wrapping film E′, in the wrapped condition as shown in FIG. 8, the external film 1*a* becomes the two-folded condition as shown in FIG. 9 by peeling the seal 13 off. Therefore, as shown in FIG. 10, when the external film 1*a* is separated by the machined line 7*b* and is separated in right and left directions, as shown in FIG. 11, the [Onigiri] 12 can be taken out in the condition where it is spontaneously wrapped in the laver.

As described in the foregoing, according to the wrapping film E or E′ of the first and second embodiments of this invention, a customer can eat [Onigiri] by separating the external film at the cut line, and needs no cumbersome work of peeling off the film or wrapping the rice in the laver as experienced heretofore, and accordingly, this invention provides an extremely sanitary eating as the customer never touch the laver or the rice directly by hands.

What is claimed is:

1. A wrapper for a food combination that includes a flat sheet of laver and a shaped mass of rice, said wrapper comprising (a) a first sheet of film having dimensions that are greater than the dimensions of the laver, (b) a second sheet of film which is smaller than said first sheet of film and which has one edge thereof bonded to a first edge of said first sheet of film, (c) a third sheet of film which is also smaller than said first sheet of film and which has one edge thereof bonded to a second edge of said first sheet of film, said first and second edges of said first sheet of film being opposite each other, (d) said second and third sheets of film being large enough to completely cover said first sheet of film when they are bonded to the aforesaid opposite edges of said first sheet of film, and to form a space between said first sheet of film and said other two sheets of film which is large enough to accommodate a laver, (e) said first sheet of film being provided with separating means which can be manually actuated to separate said first sheet of film into two separate portions along a line which is intermediate said first and second edges.

2. A wrapper according to claim 1 wherein said separating means consists of an opening tape.

* * * * *